US008910621B2

(12) United States Patent
Arnedo Vera et al.

(10) Patent No.: US 8,910,621 B2
(45) Date of Patent: Dec. 16, 2014

(54) SPRING LOADED RIFLE

(75) Inventors: Julian Arnedo Vera, Barcelona (ES); Victor Tresserras Torre, Barcelona (ES)

(73) Assignee: Gamo Outdoor, S.L., Sant Boi de Llobregat, Barcelona (ES)

( * ) Notice: Subject to any disclaimer, the term of this patent is extended or adjusted under 35 U.S.C. 154(b) by 116 days.

(21) Appl. No.: 13/810,088

(22) PCT Filed: Mar. 31, 2011

(86) PCT No.: PCT/ES2011/070222

§ 371 (c)(1), (2), (4) Date: Mar. 28, 2013

(87) PCT Pub. No.: WO2012/007616

PCT Pub. Date: Jan. 19, 2012

(65) Prior Publication Data

US 2013/0112183 A1 May 9, 2013

(30) Foreign Application Priority Data

Jul. 15, 2010 (ES) ..... 201031081

(51) Int. Cl.

| | |
|---|---|
| ***F41A 19/00*** | (2006.01) |
| ***F41A 19/58*** | (2006.01) |
| ***F41A 19/59*** | (2006.01) |
| ***F41A 11/00*** | (2006.01) |
| ***F41B 11/642*** | (2013.01) |
| ***F41B 11/71*** | (2013.01) |
| *F41B 11/57* | (2013.01) |

(52) U.S. Cl.

CPC ..... *F41A 19/59* (2013.01); *F41B 11/642* (2013.01); *F41B 11/71* (2013.01); *F41A 19/58* (2013.01); *F41B 11/57* (2013.01)

USPC ..... 124/32; 124/31; 42/69.01; 42/70.01; 42/84; 89/28.05; 89/28.1; 89/135; 89/136

(58) Field of Classification Search

CPC ..... F41A 19/58; F41A 19/59; F41B 11/57

USPC ..... 124/31, 32; 42/84, 69.01, 70.01; 89/135, 136, 28.05, 28.1

See application file for complete search history.

(56) References Cited

U.S. PATENT DOCUMENTS 2,780,882 A * 2/1957 Temple ..... 42/84
3,650,174 A * 3/1972 Nelsen ..... 89/28.05

(Continued)

FOREIGN PATENT DOCUMENTS

| | | |
|---|---|---|
| CH | 419 899 | 8/1966 |
| EP | 0655598 | 6/1999 |

OTHER PUBLICATIONS

International Search Report for Application No. PCT/ES2011/070222 dated Jul. 13, 2011.

*Primary Examiner* — Gene Kim
*Assistant Examiner* — Alexander Niconovich
(74) *Attorney, Agent, or Firm* — RatnerPrestia

(57) ABSTRACT

The invention relates to a spring-loaded air rifle which includes a trigger that actuates a firing mechanism that controls an interconnection part, which exerts a force on a counter-pawl that releases a spring that actuates a piston, in which said firing mechanism is an electronic firing mechanism which includes a flexible rod for actuating a switch.

19 Claims, 8 Drawing Sheets

(56) References Cited

U.S. PATENT DOCUMENTS

| | | | | | |
|---|---|---|---|---|---|
| 3,703,845 | A | * | 11/1972 | Griew | 89/134 |
| 3,888,021 | A | * | 6/1975 | McCurdy | 434/19 |
| 3,899,845 | A | * | 8/1975 | Wild et al. | 42/69.01 |
| 4,009,536 | A | * | 3/1977 | Wolff | 42/84 |
| 4,324,060 | A | * | 4/1982 | Lawrence | 42/84 |
| 4,433,610 | A | * | 2/1984 | Tatro | 89/148 |
| 4,510,844 | A | * | 4/1985 | Fritz et al. | 89/135 |
| 4,718,187 | A | * | 1/1988 | Blake | 42/84 |
| 4,727,670 | A | * | 3/1988 | Krouse | 42/69.01 |
| 4,793,085 | A | * | 12/1988 | Surawski et al. | 42/84 |
| 4,913,655 | A | * | 4/1990 | Pinkley et al. | 434/16 |
| 5,485,776 | A | * | 1/1996 | Ealovega | 89/130 |
| 5,713,150 | A | * | 2/1998 | Ealovega | 42/84 |
| 6,286,240 | B1 | * | 9/2001 | Collins | 42/70.08 |
| 6,354,033 | B1 | * | 3/2002 | Findley | 42/84 |
| 6,568,381 | B2 | * | 5/2003 | Chang | 124/32 |
| 6,694,963 | B1 | * | 2/2004 | Taylor | 124/32 |
| 6,763,822 | B1 | * | 7/2004 | Styles | 124/77 |
| RE38,794 | E | * | 9/2005 | Danner | 42/84 |
| 6,990,971 | B1 | * | 1/2006 | Moritz | 124/31 |
| 7,073,284 | B2 | * | 7/2006 | Monks et al. | 42/69.01 |
| 7,131,366 | B2 | * | 11/2006 | Danner et al. | 89/135 |
| 7,188,444 | B2 | * | 3/2007 | Danner et al. | 42/70.09 |
| 8,336,438 | B2 | * | 12/2012 | Compton et al. | 89/28.1 |

* cited by examiner

SPRING LOADED RIFLE

CROSS REFERENCE TO RELATED APPLICATIONS

This application is the U.S. National Phase Application of PCT/ES2011/070,222, filed Mar. 31, 2012, which claims priority to Spanish Patent Application No. 201031081, filed Jul. 15, 2010.

FIELD OF THE INVENTION

This invention relates to a spring-loaded rifle of the type described in EP 0655598, incorporated herein by reference, which is fired through electronic means in order to improve the performance provided to the user as explained below.

BACKGROUND OF THE INVENTION

Rifles comprising a spring of the type described in EP 0655598 are spring-loaded rifles which unlike those of the PCP (Pre Charged Pneumatic) type do not require an external source of pressurised gas to discharge shot or any kind of munition.

In spring-loaded rifles air is compressed manually by means of a spring. As a consequence, activating the trigger (firing) releases a spring which activates a piston. Rapid movement by the piston causes the air in a container to be compressed. The compressed air present in the container or caused through the action of the piston is subsequently discharged through an opening of diameter smaller than the container, which helps to increase the pressure of the air. Finally the discharged compressed air is used to impel a shot or other type of munition.

The rifles have substantially poorer performance with regard to accuracy than a rifle of the PCP type. The main difference in performance is due to the need for parts to move during firing, which causes vibration and recoil. Nevertheless spring-loaded rifles are an important option because of their low cost and their need for few additional accessories, such as pre-compressed gas cylinders, among others.

At the present time spring-loaded rifles are mechanically fired by means of a trigger and a counter-ratchet which are released through the action of the trigger, allowing the air compressed by the spring to pass through the barrel.

In order to improve accuracy it is necessary for the user's action on the trigger to require the least force possible, given that action of greater force on the trigger causes undesirable movement of the rifle at the time of firing. Thus at the present time the connection between the trigger and the counter-ratchet has an area of contact which is as small as possible. This ensures that the required movement to release the counter-ratchet and therefore to fire is small, requiring less force to activate it.

This type of mechanism to reduce the amount of force necessary to activate firing has the result that when the contact surfaces are very small, any force applied externally, for example by an impact, even if not directly acting on the trigger, causes the trigger and the counter-ratchet to disengage, activating undesired firing. Hence the need to have the smoothest possible firing in a weapon which passes safety tests such as for example that known as the drop test. This test comprises dropping the weapon freely in all possible positions of the rifle, and the test is passed if the rifle does not fire in any position.

According to this invention an electronic firing mechanism may be incorporated so that the least force possible is used and a contact surface between the trigger and counter-ratchet which guarantees safety is maintained. Through the use of a firing mechanism of this type there is no need to overcome the friction force between the two surfaces, given that the system of operation is different, as only the force necessary to activate a switch is used. The trigger and counter-ratchet are preferably disconnected through an internal mechanism through the action of a solenoid, but any other electromechanical firing mechanism may be used.

BRIEF DESCRIPTION OF THE INVENTION

Thus one object of this invention is to provide a rifle with a type of firing mechanism such that it is not necessary to reduce the contact surfaces between the trigger and counter-ratchet excessively and ensure firing through exerting minimum force on the trigger in order to activate it.

Thus it is sufficient that the trigger is preferably activated through electrical means, and this requires some electromechanical mechanism acting as an interface between man and rifle must be used.

In order to solve this problem one object of this invention is to provide a mechanism for activating a switch for a firing mechanism of the electronic type that is designed to simulate the feel of conventional firing mechanisms. Conventional firing mechanisms allow free initial rotation of the trigger until the point of firing is reached, and once at this point the trigger offers slightly greater resistance, indicating to the user that it is very close to the point of firing. In an ideal mechanism the trigger should be capable of moving very gently to the point of firing, and once there the resistance should be slightly greater but not excessive so that an accurate shot can be fired.

As a consequence this invention incorporates a firing mechanism making use of a flexible rod through which the trigger can be moved freely until it reaches a point of firing. At this point it is necessary to overcome the resistance which activates the switch of the firing mechanism.

A spring-loaded rifle according to this invention comprises:

a trigger, which activates
a firing mechanism, which acts upon
an interconnection part, which exerts a force on
a counter-ratchet, which releases
a spring activating a piston in which the said firing mechanism is an electronic firing mechanism comprising a flexible rod to activate a switch.

The interconnecting part is preferably capable of articulation and allows the direction of the force generated by the horizontal movement of the electromechanical actuator to be changed into a vertical force which disconnects the trigger and the counter-ratchet enabling the spring to be activated and allowing the gas compressed by the piston to pass through the barrel.

This flexible rod is preferably mechanically coupled to the trigger and the trigger moves the rod until it touches the switch. In addition to this, this switch activates an electromechanical actuator.

The interconnection part may further comprise a first part fixed to the body of the rifle and a second part fixed to the counter-ratchet, so that the first and second parts are joined by an articulation. The electromechanical actuator subsequently exerts force in this articulation causing the part to receive a horizontal force and converting it into a force which is substantially perpendicular to that received.

In another preferred embodiment the rifle has an auxiliary firing mechanism which is independent of the electronic firing mechanism. This firing mechanism is important because it must allow the rifle to be used if for any reason the electronic firing mechanism should fail. Such use, in addition to firing the rifle, makes it possible to continue firing at targets with substantially less accuracy but maintaining the same firing system (activation of the trigger). That is to say that the independent auxiliary firing mechanism comprises means for firing the rifle and for fixing with substantially poorer performance than provided by the electronic firing mechanism.

Preferably the firing mechanism for the rifle should comprise a trigger locking mechanism which prevents it from moving when the user so desires so that no accidental firing occurs, and preferably this firing mechanism further comprises the second means for interrupting the current to the solenoid to act as an electrical safety device so that the solenoid cannot be energised if this switch is not in the firing position. Even more preferably the second switch comprises an activating lever which acts as a mechanism locking the trigger. Thus both mechanism and electrical immobilisation of the trigger is achieved through a single device.

Furthermore, in order to activate the switch but maintain the feel of firing the firing mechanism comprises a flexible rod to activate the switch. This flexible rod is mechanically coupled to the trigger and the trigger moves the rod until the trigger touches the switch.

Preferably the firing mechanism further comprises a plate which prevents the electromechanical actuator from acting on other parts when the trigger is in the resting position and the said plate further comprises a guide for the flexible rod.

BRIEF DESCRIPTION OF THE DRAWINGS

The invention is best understood from the following detailed description when read in connection with the accompanying drawings.

DETAILED DESCRIPTION OF THE INVENTION

Figure 1:
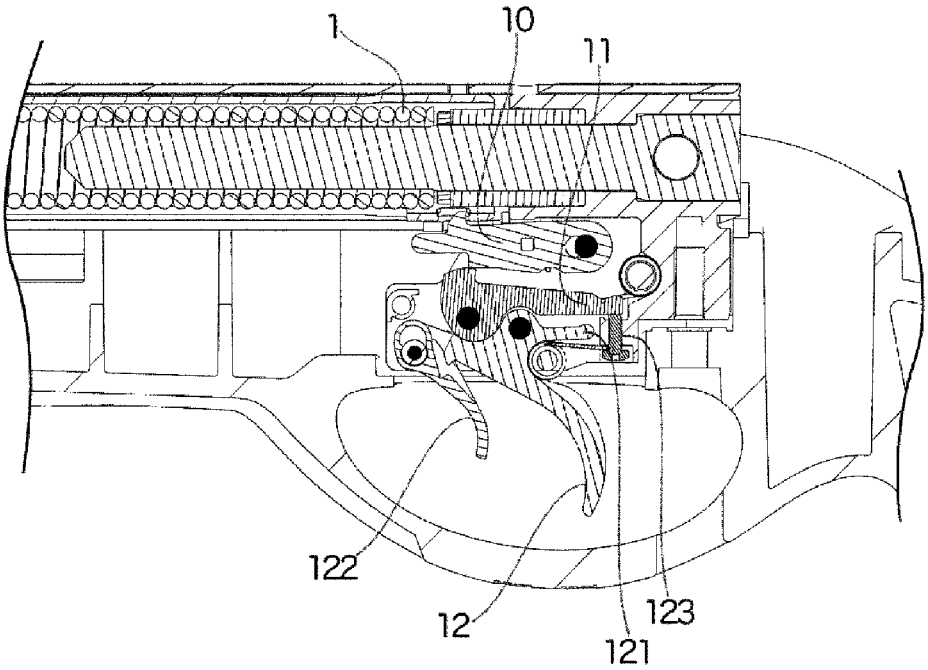
FIG. 1 (PRIOR ART)
FIG. 1 illustrates the prior art relating to spring-loaded rifles.

FIG. 1 illustrates a rifle that is fired exclusively through mechanical means. It comprises a spring -1- and a piston coupled to said spring which is held in position by means of a ratchet mechanism -10- in the energy-accumulating position. By way of firing mechanisms there is a counter-ratchet -11- and a trigger -12-. It will be seen that there is a contact surface between ratchet mechanism -10- and counter-ratchet -11-, which ideally is as small as possible, but must withstand safety tests ensuring adequate functioning. The smaller the contract surface between ratchet mechanism -10- and counter-ratchet -11- the smaller the force required for firing (the ideal situation for the user), but safety is also reduced because dropping the weapon or the action of any force upon it can cause it to fire.

Firing is brought about by rotating trigger -12- clockwise. First of all trigger -12- moves freely until extension -121- comes into contract with counter-ratchet -11-. The point of firing has then been reached, given that any movement beyond that point will cause ratchet mechanism -10- and counter-ratchet -11- to disengage, that is to fire. Furthermore the rifle must have a safety system to prevent trigger -12- from being pressed accidentally. This safety is achieved through incorporating a safety catch -122- with the trigger. It should be pointed out that this safety catch -122- only prevents trigger -12- from being pressed, whereas dropping the rifle or an involuntary impact may cause counter-ratchet -11- to move causing it to become disengaged from ratchet mechanism -10-. Thus the contact surface between the two must be sufficient to provide safety and be sufficiently smooth to assist the shooter's accuracy. Furthermore, given that each shooter has his preferences as regards the force required to effect firing, rifles according to the prior art have a screw -123- allowing adjustment which defines the contact surface between ratchet mechanism -10- and counter-ratchet -11- and as a consequence the force required to disengage them.

Figure 2:
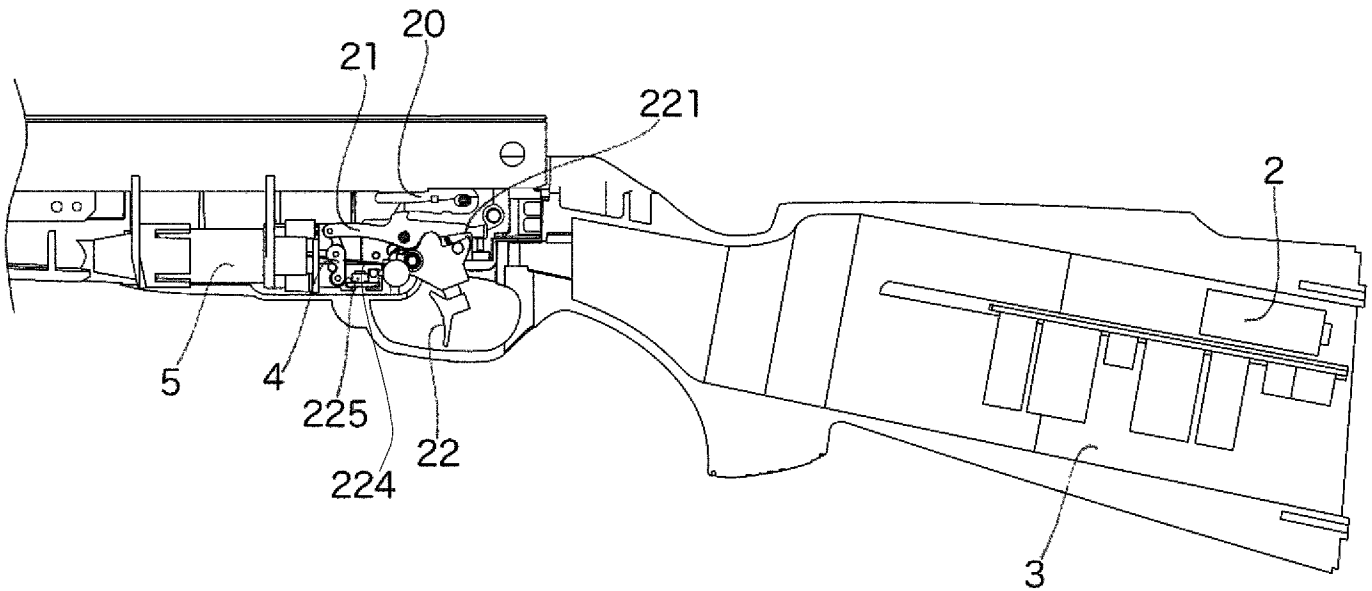
FIG. 2 shows an example embodiment of a rifle according to this invention.

FIG. 2 illustrates a rifle according to this invention. A rifle with electronic firing comprises a battery -2- and a circuit -3- to deliver the energy obtained from the battery and raise it to a sufficient voltage level to have sufficient mechanical force to move the counter-ratchet -21- similar to that known in the state of the art. Continuing with the electronic components, firing the rifle according to this invention is brought about by triggering a switch -225- which enables electrical energy to pass to a solenoid -5- which converts this electrical energy into mechanical energy to bring about firing.

With regard to the mechanical components, this invention comprises a counter-ratchet -21- similar to that known in the state of the art, in that it has an area of contact with a ratchet mechanism -20- which disengages at the time of firing to allow a spring (not shown) to act and compress and release air causing a projectile to be discharged. In order to bring about this disengagement the horizontal component of the force provided by solenoid -5- has to be converted into the vertical component of a force which causes counter-ratchet -21- to rotate, disengaging it from ratchet mechanism -20-. This change in the direction of the force is achieved through a knee piece -4- or articulatable part which will be explained in greater detail below. The rifle illustrated in FIG. 2 also has an auxiliary mechanical firing system; if for any reason the electronic firing mechanism should not function there is an auxiliary firing mechanism which is not as accurate and does not offer the performance of the electronic firing mechanism, but nevertheless permits acceptable firing which in addition to discharging the weapon makes it possible for it to be used with acceptable accuracy. This firing mechanism is achieved through extension -221- which causes counter-ratchet -21- to rotate in a manner functionally similar to extension -121- in the prior art, given that if the switch is operated and fails to function the flexibility of rod -224- will enable the trigger to continue to rotate allowing extension -221- to move counter-ratchet -21-.

Figure 3:
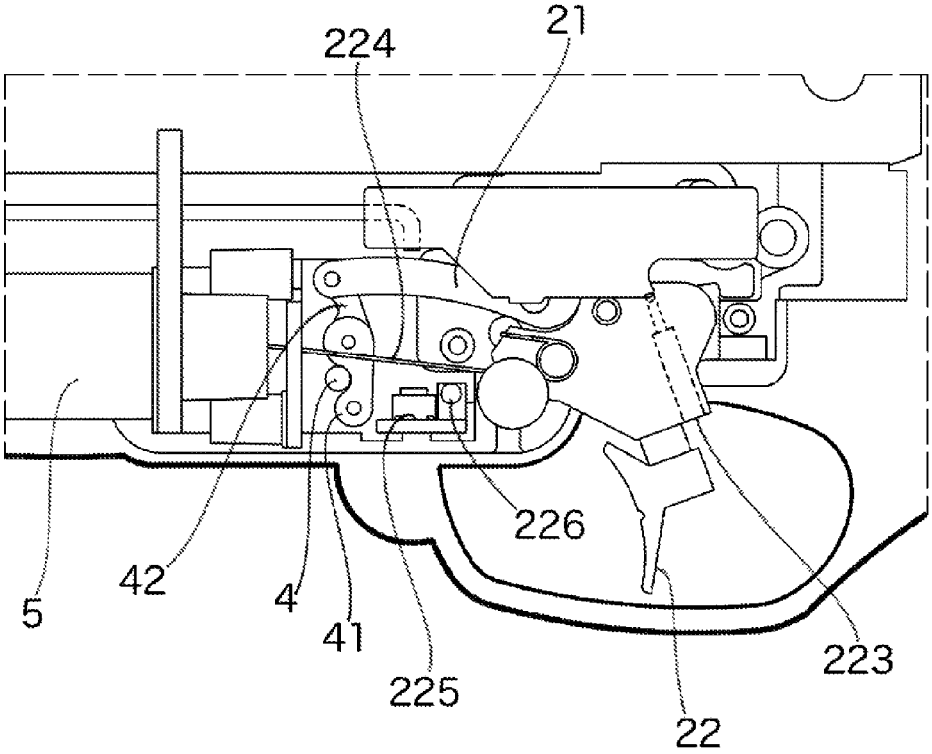
FIG. 3 shows details of an electronic firing mechanism according to this invention.

FIG. 3 illustrates an electronic firing mechanism in detail. Firing is brought about by causing counter-ratchet -21- to rotate in a similar way to that in rifles according to the prior art.

Thus in the case of the mechanical firing system it was sufficient to have a device which applied the vertical component of a force to one of the extremities of the counter-ratchet in order to effect firing, while the firing mechanisms according to this invention bring about a similar event. The problem arising is that the force must be of non-negligible magnitude, and in order to achieve this force in a vertical direction a solenoid -5- of considerable size is used, which being vertically mounted would affect the aesthetics and the ergonomics of the rifle. As a consequence it is best that this solenoid -5- should be located in a horizontal direction and a part enabling the horizontal component of the force exerted by the solenoid to be converted into a force in a vertical direction which causes the counter-ratchet to rotate.

In this invention this change in the direction of the force is brought about through an articulatable part or knee piece -4-. This knee piece -4- comprises a first part -41- which is supported on a fixed part of the rifle, such as its body, and a second part -42- which is supported on the counter-ratchet and has a junction between the parts such that it is possible to effect a horizontal movement when a force is applied to the junction. The functioning of the knee piece is such that when it receives a horizontal movement at the junction between the two parts, given that the first part -41- is supported on a fixed point of the rifle, a force is exerted by second part -42- in a vertical direction against the counter-ratchet causing it to rotate and as a consequence fire the rifle.

The firing mechanism further comprises a trigger -22- whose position can be adjusted in order to be suitable to the shooter, a screw -223- to adjust the force required to move trigger -22-, a switch -225- whose function is to make the circuit providing energy to solenoid -5-, activating it, and a light emitting diode LED -226- which is used to indicate that the electronic firing mechanism is in an operating condition. In order to fire, all that is necessary is to press switch -225-. On the other hand the need to maintain a touch similar to that of rifles with a conventional firing system is an important point for increasing the user's accuracy, and thus switch -225- operates through a mechanism which we will call a "flexible rod". This mechanism is based on the use of a rod -224- which has a substantially straight-line geometry at rest, the trigger moving until this rod reaches a stop (which may be the switch itself) which simulates the point at which the shooter knows that he is close to activating the switch. Once there the rod begins to adopt a substantially more curved geometry until it overcomes the force of switch -225-.

Figure 4:
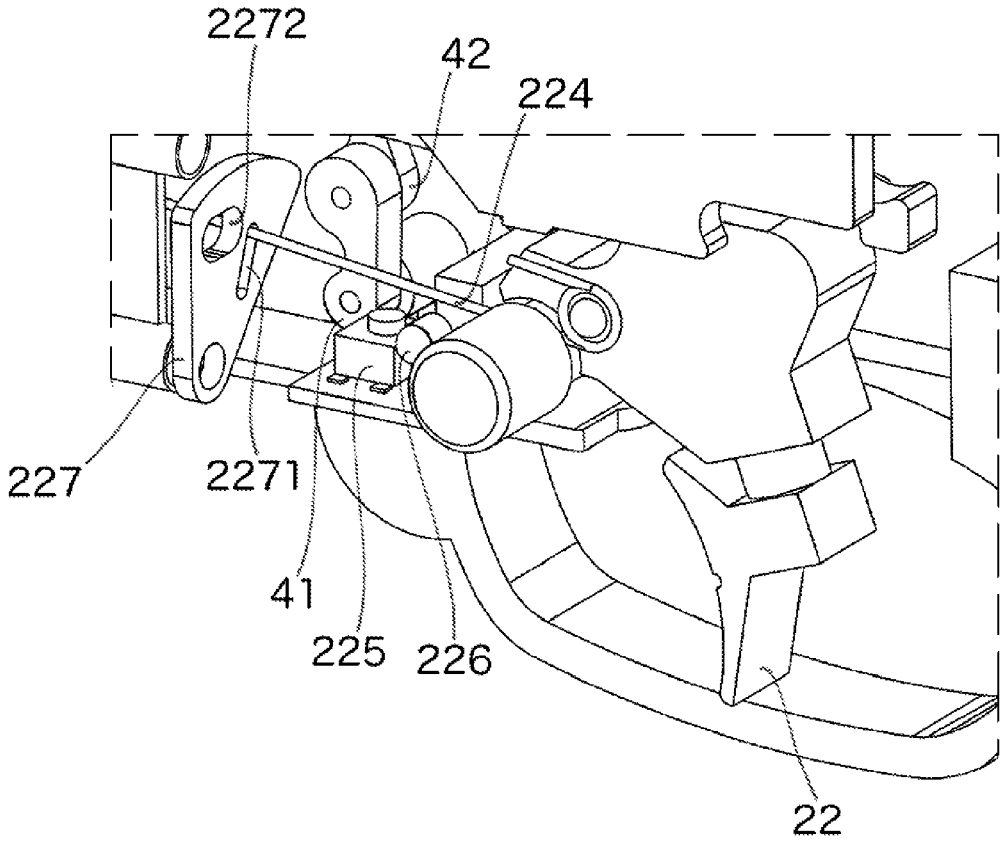
FIG. 4 shows a rifle according to this invention with the trigger in the resting position.
Figure 5:
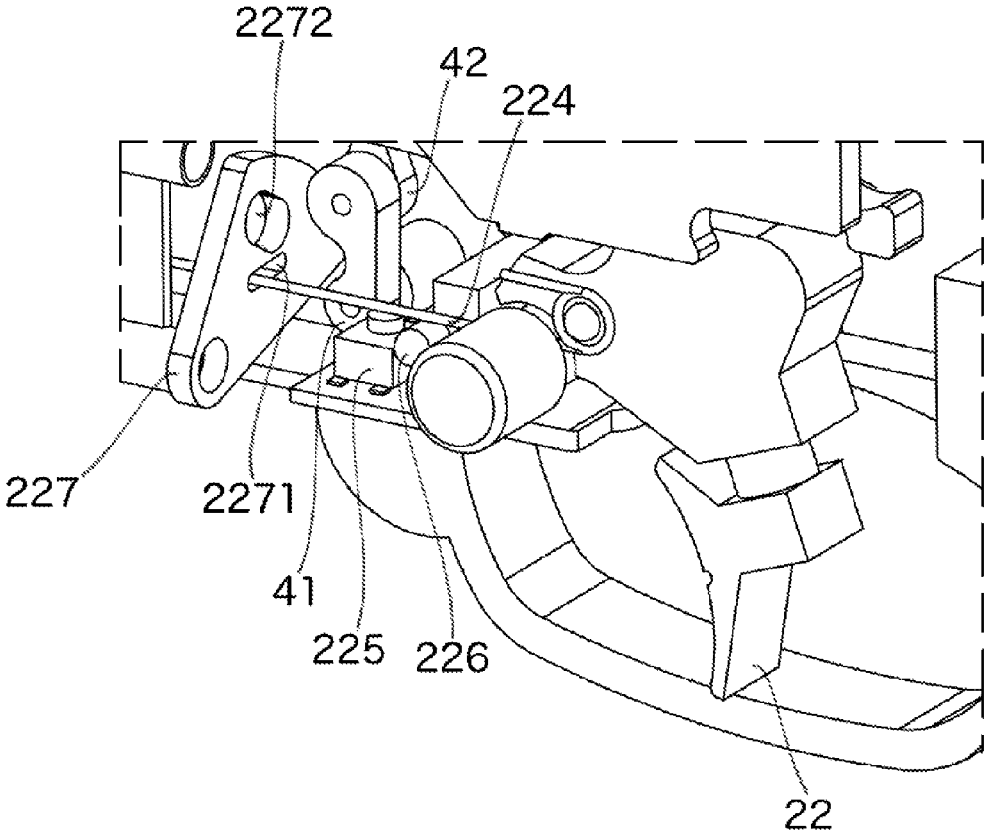
FIG. 5 shows a rifle according to this invention with the trigger at the point of firing.
Figure 6:
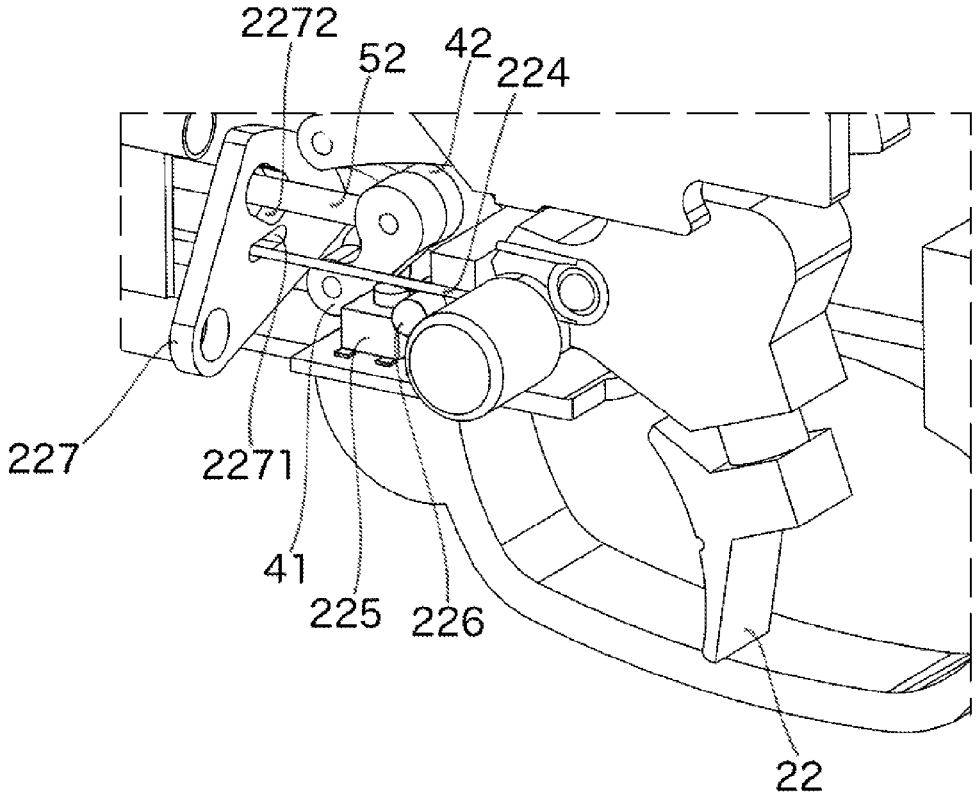
FIG. 6 shows a rifle according to this invention with the trigger in the final position.

FIGS. 4, 5 and 6 illustrate the functioning of the firing mechanism for three different trigger positions.

FIG. 4 illustrates the firing mechanism when the trigger is in a passive position (without any action on the part of a user). It should be noted that rod -224- is in its initial position, separate from switch -225-. In order to provide better protection and to have a guide for rod -224- using only a single device the rifle according to this invention has a plate -227- which in addition to acting as a guide for rod -224- acts as a barrier to prevent the solenoid (not shown) from activating knee piece -41-, -42- without the switch having been pressed (for example as a result of being dropped, an impact, etc.). This plate comprises a guide -2271- to hold the rod on a specific path and a hole -2272- which allows the actuator of the solenoid to pass when rod -224- is in a suitable position for firing (indicating that trigger -22- has been operated).

FIG. 5 shows rod -224- when it is in the firing position, and it should be noted that rod -224- is already in contact with the switch giving the user warning as the resistance required to rotate trigger 22 increases, so that the user knows precisely when he is at the point of firing.

FIG. 6 shows rod -224- when it activates switch -225- causing the rifle to fire; further it will be noted how it passes through plate -227- and the solenoid actuator through hole -2272- activating knee piece -41-, -42-.

Figure 7:
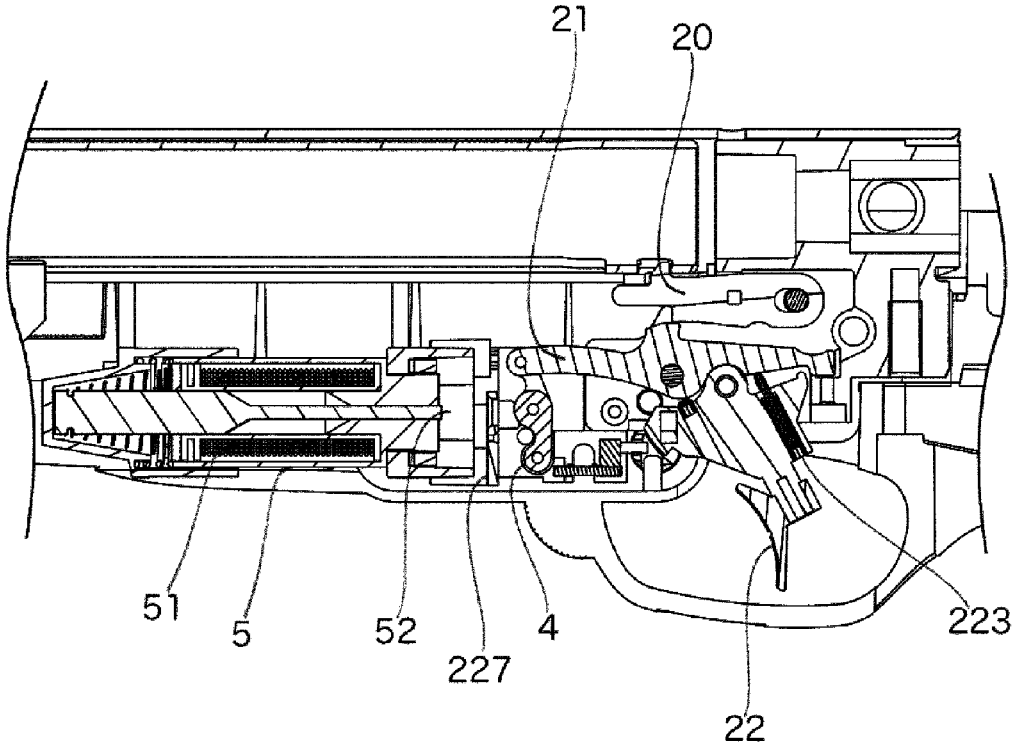
FIG. 7 shows the solenoid of the rifle according to this invention in the resting position.
Figure 8:
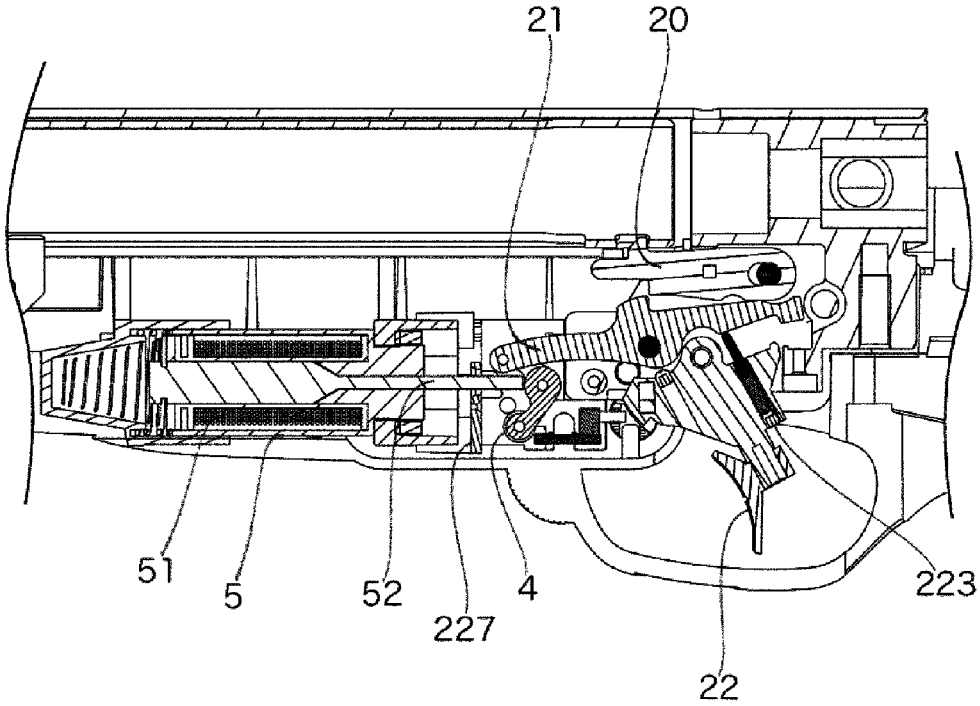
FIG. 8 shows the solenoid of the rifle according to this invention in the final position.

FIGS. 7 and 8 show a diagrammatical view to illustrate the operation of the firing mechanism in detail. FIG. 7 shows the rifle in the resting position (without action on the part of the user) and FIG. 8 shows the rifle in the active position (at the moment of firing).

FIG. 7 shows knee piece -4- in its resting position, that is to say without applying a vertical component of a force to counter-ratchet -21-. Furthermore it will be seen that solenoid -5- and its corresponding activator 52 and spring 51 are in a passive position, that is to say not receiving electrical energy.

FIG. 8 shows how when trigger -22- is pressed to the final position the switch (not shown) is activated supplying electrical energy to solenoid -5- with the result that through its coil -51- it exerts a horizontal component of an electromechanical force against actuator -52- causing the latter to pass through a plate -227- until knee piece -4- moves into an active position. At this moment the knee piece exerts a vertical component of a force which causes counter-ratchet -21- to rotate, becoming disengaged from ratchet mechanism -20- and as a consequence releasing the spring which brings about firing.

In a particular embodiment the rifle according to this invention comprises an electromechanical safety mechanism which prevents the trigger from being moved and breaks the switch circuit making both electrical and mechanical operation of the rifle impossible.

Although the invention has been described in relation to preferred embodiments, these should not be regarded as limiting the invention, which is defined by the following claims.

The invention claimed is:

1. A spring-loaded rifle comprising:

a trigger;

a firing mechanism an interconnection piece;

a counter-ratchet; and a spring-driven piston comprising a spring-loaded configuration held in place by the counter-ratchet;

the trigger configured to activate the firing mechanism, which is configured to act upon the interconnection piece, causing the interconnection piece to exert a force upon the counter-ratchet, which causes the counter-ratchet to release the piston from the spring-loaded configuration;

the firing mechanism comprising an electronic firing mechanism comprising a flexible rod, an electromechanical actuator, and a switch, the flexible rod mechanically coupled to the trigger, the electromechanical actuator operable by the switch, the switch positioned to be activated by the flexible rod, the flexible rod configured to move in response to a first trigger force until the flexible rod contacts a stop, after which a second, relatively greater, trigger force is required to move the trigger to bend the flexible rod to activate the switch.

2. The rifle according to claim 1, wherein the stop comprises the switch.

3. The rifle according to claim 1, in which the electromechanical actuator acts with a force in a direction substantially parallel to the direction of a barrel of the rifle.

4. The rifle according to claim 1, in which the electromechanical actuator comprises a solenoid.

5. The rifle according to claim 4, in which the electronic firing mechanism further comprises a second switch configured to interrupt current to the solenoid for use as a safety device.

6. The rifle according to claim 5, in which the second switch comprises an activating lever which acts as a trigger locking mechanism.

7. The rifle according to claim 1, in which the interconnection part is an articulated part to change the direction of action of the force originating from the electromechanical actuator.

8. The rifle according to claim 1, wherein the rifle comprises a body, in which the said interconnection part comprises:

a first part fixed to the body of the rifle; and a second part attached to the counter-ratchet;

wherein the first and second parts are joined by an articulation.

9. The rifle according to claim 1, further comprising an auxiliary firing mechanism independent of the electronic firing mechanism.

10. The rifle according to claim 9, in which the said independent auxiliary firing mechanism comprises means for discharging the rifle activated by continued travel of the trigger beyond a point at which the electronic firing mechanism switch is activated.

11. The rifle of claim 10, wherein the independent auxiliary firing mechanism comprises a mechanical component coupled to the trigger and configured to move the counter-ratchet into the counter-ratchet release position with the trigger in an auxiliary firing position.

12. The rifle according to claim 1, in which the electronic firing mechanism further comprises a trigger locking mechanism.

13. The rifle according to claim 1, in which the firing mechanism comprises a plate which prevents the electromechanical actuator from acting on other parts when the trigger is in the trigger resting position.

14. The rifle according to claim 13, in which the plate further comprises a guide for the flexible rod.

15. The rifle of claim 14, wherein the plate is movable between a first plate position corresponding to a trigger resting position in which the plate is a barrier to the electromechanical actuator contacting the interconnection part and a second plate position corresponding to a trigger firing position in which the electromechanical actuator is aligned with an aperture in the plate that permits the actuator to pass through the plate to contact the interconnection part.

16. The rifle of claim 15, wherein the plate further comprises a guide for the flexible rod, the guide configured such that movement of the rod between a first rod position corresponding to the trigger resting position and a second rod position corresponding to the trigger electronic firing position causes the plate to move between the first plate position and second plate position.

17. The rifle of claim 16, wherein the guide comprises a slot in the plate through which the flexible rod passes, and the plate is pivotable between the first plate position and the second plate position.

18. The rifle of claim 1, wherein the flexible rod has a proximal end connected to the trigger, a distal end, and an switch contact portion between the proximal end and distal end positioned to contact the switch.

19. The rifle of claim 1, wherein the switch has an activation resistance force and the rod has a first geometry in which it makes initial contact with the switch and a second geometry, more curved than the first geometry, in which a force exerted by the rod on the switch overcomes an activation resistance force of the switch.

* * * * *